US007213358B2

(12) United States Patent
Kellerman

(10) Patent No.: US 7,213,358 B2
(45) Date of Patent: May 8, 2007

(54) TRIGGER SYSTEM FOR SMALL ARMS

(75) Inventor: Harald Kellerman, Eckernförde (DE)

(73) Assignee: S.A.T. Swiss Arms Technology AG, Neuhausen (CH)

( * ) Notice: Subject to any disclaimer, the term of this patent is extended or adjusted under 35 U.S.C. 154(b) by 0 days.

(21) Appl. No.: 11/202,931

(22) Filed: Aug. 12, 2005

(65) Prior Publication Data

US 2006/0032101 A1 Feb. 16, 2006

Related U.S. Application Data

(63) Continuation of application No. PCT/EP2003/014587, filed on Dec. 19, 2003.

(30) Foreign Application Priority Data

Feb. 20, 2003 (DE) ..... 103 07 222

(51) Int. Cl.
*F41A 3/00* (2006.01)

(52) U.S. Cl. ..... 42/69.03; 89/147

(58) Field of Classification Search ..... 42/69.03; 89/147

See application file for complete search history.

(56) References Cited

U.S. PATENT DOCUMENTS 2,846,925 A * 8/1958 Norman ..... 89/145
3,152,418 A 10/1964 Charron
5,797,206 A * 8/1998 Vitorino ..... 42/69.03
6,341,442 B1 1/2002 Szabi et al.

FOREIGN PATENT DOCUMENTS

| | | | |
|---|---|---|---|
| DE | 582963 | | 8/1933 |
| GB | 291747 | | 11/1928 |
| WO | WO 03004957 | | 1/2003 |
| WO | WO/2004/074759 | * | 2/2004 |

* cited by examiner

*Primary Examiner*—Michael J. Carone
*Assistant Examiner*—Gabriel J. Klein
(74) *Attorney, Agent, or Firm*—Martin Fleit; Paul D. Bianco; Fleit Kain Gibbons Gutman Bongini & Bianco P.L.

(57) ABSTRACT

The invention relates to a trigger system for small arms, said system including a hammer, a catch associated with the hammer, a trigger, and a trigger bar which cooperates with the trigger and has a first locking edge for engaging with a first fire locking element of the hammer. The aim of the invention is to create a trigger system which has a low trigger resistance and remains operable even in the event of firing failure. To this end, the trigger bar has a second locking edge for engaging with a second fire locking element of the hammer.

10 Claims, 7 Drawing Sheets

TRIGGER SYSTEM FOR SMALL ARMS

CROSS-REFERENCE TO RELATED APPLICATION

This application is a continuation of International Application No. PCT/EP2003/014587, filed Dec. 19, 2003, the contents of which are incorporated herein by reference.

FIELD OF THE INVENTION

The invention concerns a trigger system for small arms.

BACKGROUND OF THE INVENTION

So-called Double Action Only trigger systems are already known as pure tension triggers, in which the hammer must first be placed under tension by the trigger for each shot. Through such trigger systems, high safety is provided for the weapon, since it can be stored or laid aside without an additional release of tension. However, conventional Double Action Only trigger systems have uniform trigger travel and a relatively high trigger resistance.

There are also trigger systems that are already partly under tension and have shorter trigger travel and make it possible to set off a shot with low trigger resistance. Often, however, a second pull is not possible in these trigger systems after a firing failure.

From U.S. Pat. No. 6,341,442 B1, a trigger system for Double Action small arms is known with a hammer, a locking edge associated with the hammer, a trigger, and a trigger bar that cooperates with it. The trigger bar in this known system has a rear arm with a single projection to make contact with an associated contact surface of the hammer.

SUMMARY OF THE INVENTION

An object of the invention is to create a trigger system for small arms that has a low trigger resistance and also remains able to operate in case of a firing failure.

This object is achieved by a trigger system with the characteristics of claim 1. Appropriate embodiments and advantageous further developments of the invention are given in the dependent claims.

The way in which the trigger system according to the invention operates corresponds to that of a Double Action Only trigger system placed under partial tension. By repetition (manually or by holding the trigger back after the first shot has been taken), the trigger system comes to an operating position under partial tension, in which the stored energy of the strike-hammer spring applied to the hammer is not yet sufficient to fire a cartridge. By activating the trigger, the hammer can first be placed under additional tension and then released to trigger a shot. Through a first locking edge of the trigger bar and the associated first fire-locking element of the hammer, the trigger system can be activated, on the basis of the favorable leverage, about the center of rotation of the hammer with a small force expenditure. After the first shot, however, there is also the possibility that the trigger system, through the second locking edge on the trigger bar and the associated second fire-locking element, can be activated with significantly shorter trigger movement, though with a somewhat higher expenditure of force. When the trigger bar is moved in the direction that releases the hammer, the second locking edge can come into contact with the associated second fire-locking element sooner, and trigger of a shot is possible with shorter trigger travel. In this case, however, because of the unfavorable lever of the second locking edges and the second firing edge involved with respect to the center of rotation of the hammer, a somewhat high expenditure of force is required. With the aid of the second locking edge and the associated second firing edge, another activation of the trigger system is also possible after a firing failure, but then with a somewhat higher expenditure of force and a longer trigger travel.

BRIEF DESCRIPTION OF THE DRAWINGS

Other special features and advantages of the invention can be seen from the following description of a preferred embodiment example, with reference to the drawing, in which.

DETAILED DESCRIPTION OF THE INVENTION

Figure 1:
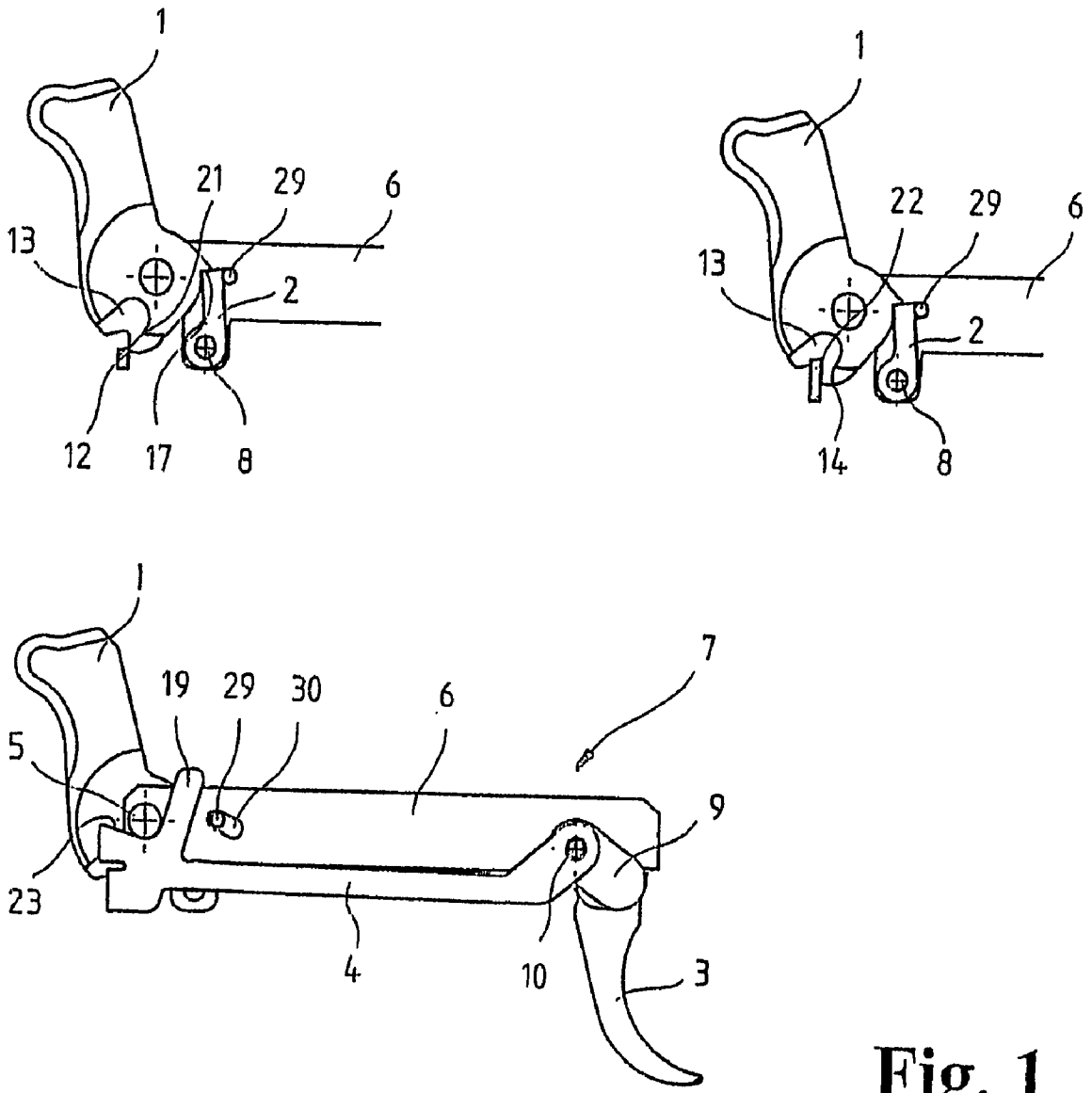
FIG. 1 shows a trigger system for small arms according to the invention in a position under preliminary tension.

The trigger system for small arms shown schematically in FIGS. 1 through 4 contains a hammer 1 with a catch 2, a trigger 3 with a trigger bar 4 connected to it by a link, through which the hammer 1 is released during activation of the trigger 3, first being placed under tension against the force of a hammer spring (not shown), and then released to set off a shot. The trigger bar 4 is moved back by a trigger spring (not shown) that pushes the trigger 3 into a forward exit position and is likewise pushed up by a trigger-bar spring (not shown).

As can be seen from the lower illustration in FIG. 1, the hammer 1 is arranged so as to be movable about a hammer axis 5 between two side parts 6 of a carrier element 7 that are separated from each other by a gap. Between the two side parts 6 of the carrier element 7, a catch 2 is also mounted so as to be movable about a cross-pin 8. Through this catch 2, the hammer 1 is held in a position under partial tension, as will be explained in more detail below. The arrangement of the catch 2 can be recognized especially well in the upper illustrations of each of FIGS. 1 through 4, where the frontmost side of the two side parts 6 of the carrier element 7 has been omitted. The trigger 3 is also arranged on the carrier element 7. It contains a side connecting part 9, which faces obliquely upward, with a side link pin 10, which projects forward and is connected by a link to the front end of the trigger bar 4. The trigger 2 [sic; 3], the linking part 9, and the link pin 10 are formed as a single part in the embodiment shown.

Figure 5:
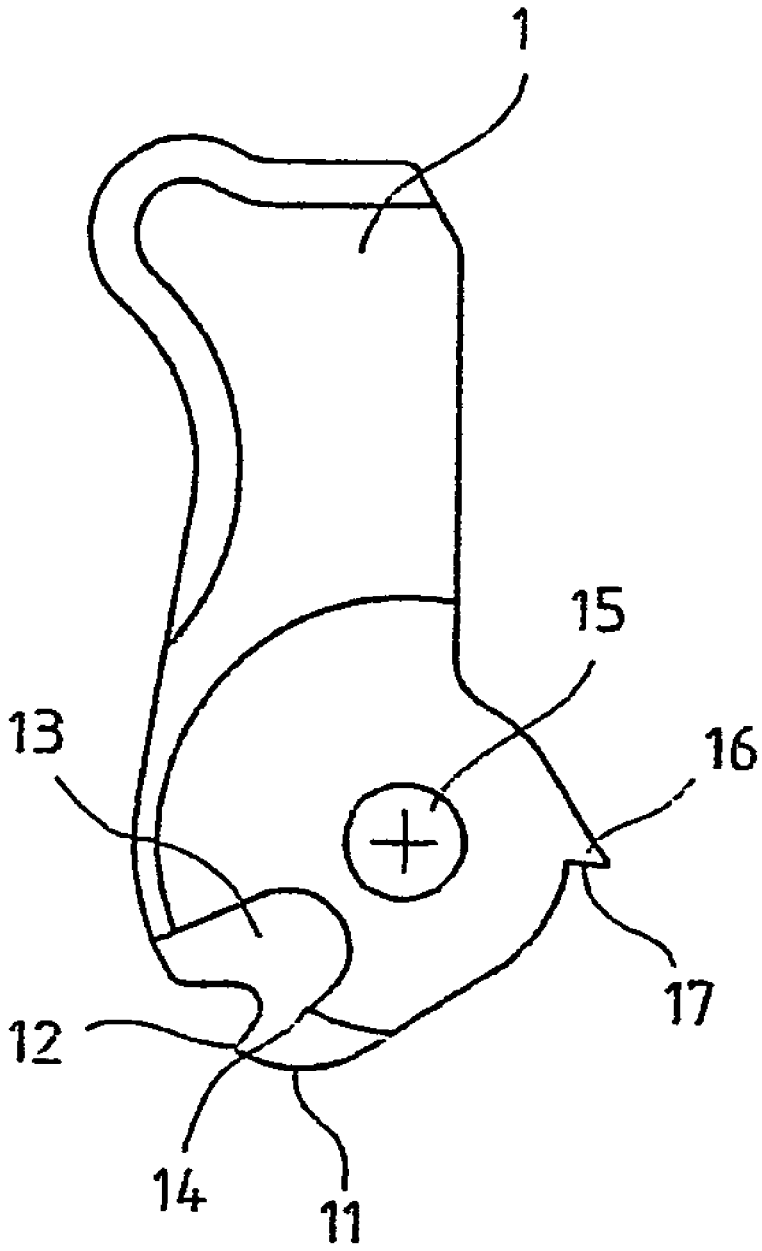
FIG. 5 shows the hammer of the trigger system in FIGS. 1 through 4 in an enlarged side view.

As can be seen especially from FIG. 5, the hammer 1 contains on its bottom a control arc 11 and a first, lower fire-locking element 12. The hammer also has on its side facing the trigger bar 4 a free cut 13 with a second, upper fire-locking element 14. Above the free cut 13, the hammer 1 also contains a traverse hole 15 for the hammer axis 5 shown in FIG. 1, through which the hammer 1 is arranged so as to be movable between the side parts 6 of the carrier element 7. The second fire-locking element 14 is above the first fire-locking element 12 and is arranged so as to be movable forward with respect to it. On the front of the hammer 1 a safety cam 16 is also provided, with a safety stop 17 to contact the catch 2.

Figure 6:
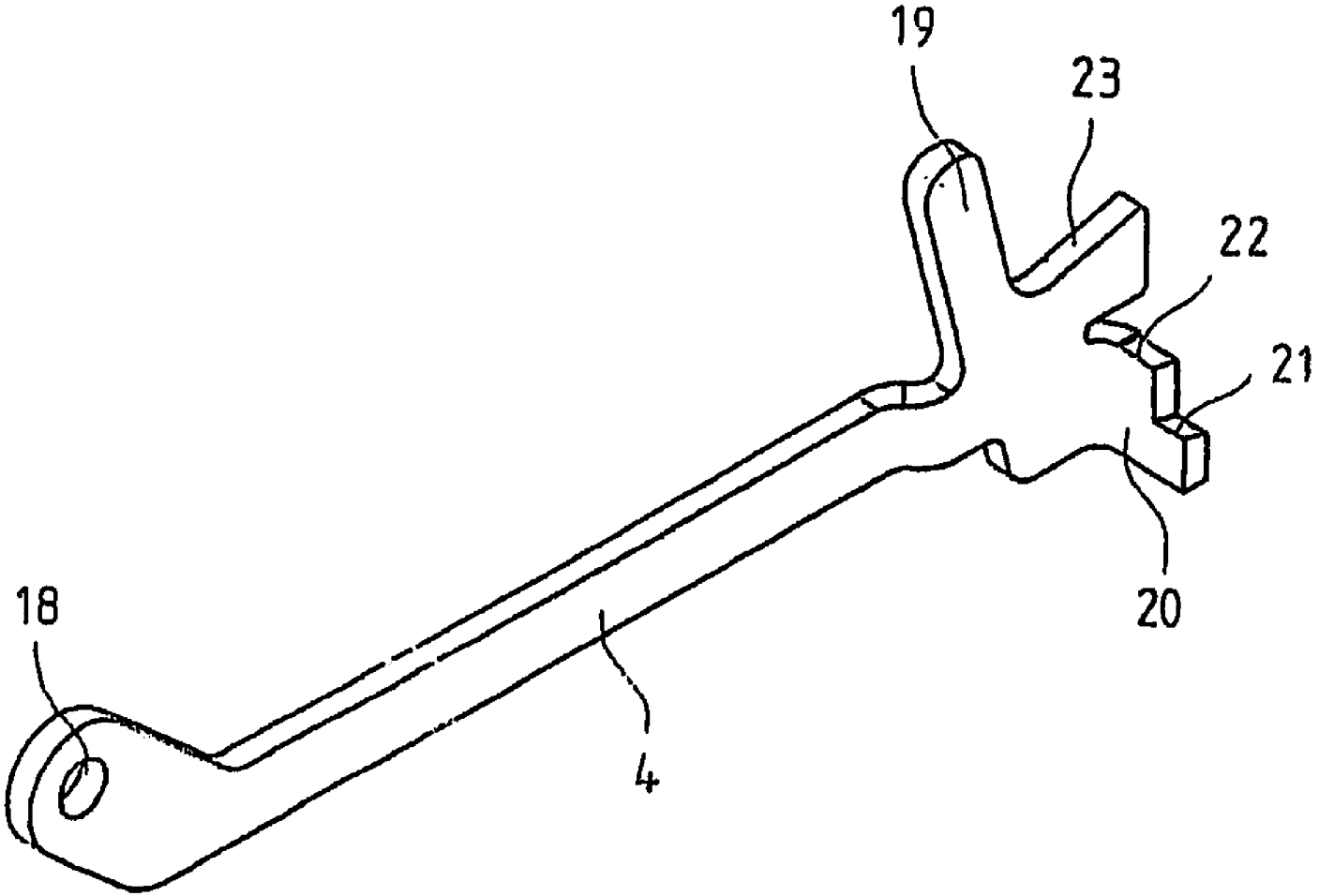
FIG. 6 shows the stop bar of the trigger system shown in FIGS. 1 and 4 in a schematic perspective.

The trigger bar 4 illustrated in FIG. 6 has at its front end, which is turned up, a hole 18 for insertion of the link pin 10 of the trigger 3, which projects to the side. At its back end, which is cut off on the inside, the trigger bar 4 contains a control cam 19, which projects upward, and a segment 20 that projects in the direction of the hammer 1, with a first lower locking edge 21 and a second locking edge 22, which is located to the side and upward from it. The first locking edge 21 cooperates with the first fire-locking element 12, while the second, upper locking edge 22 engages with the free cut 13 and cooperates with the second fire-locking element 14. In the embodiment shown, segment 20 consists of a lower part of the trigger bar 4 that is curved inward at a right angle. The trigger bar 4 also has a control bevel 23 that runs obliquely upward to the position on a part of the hammer axis 5 that projects outward.

Figure 7:
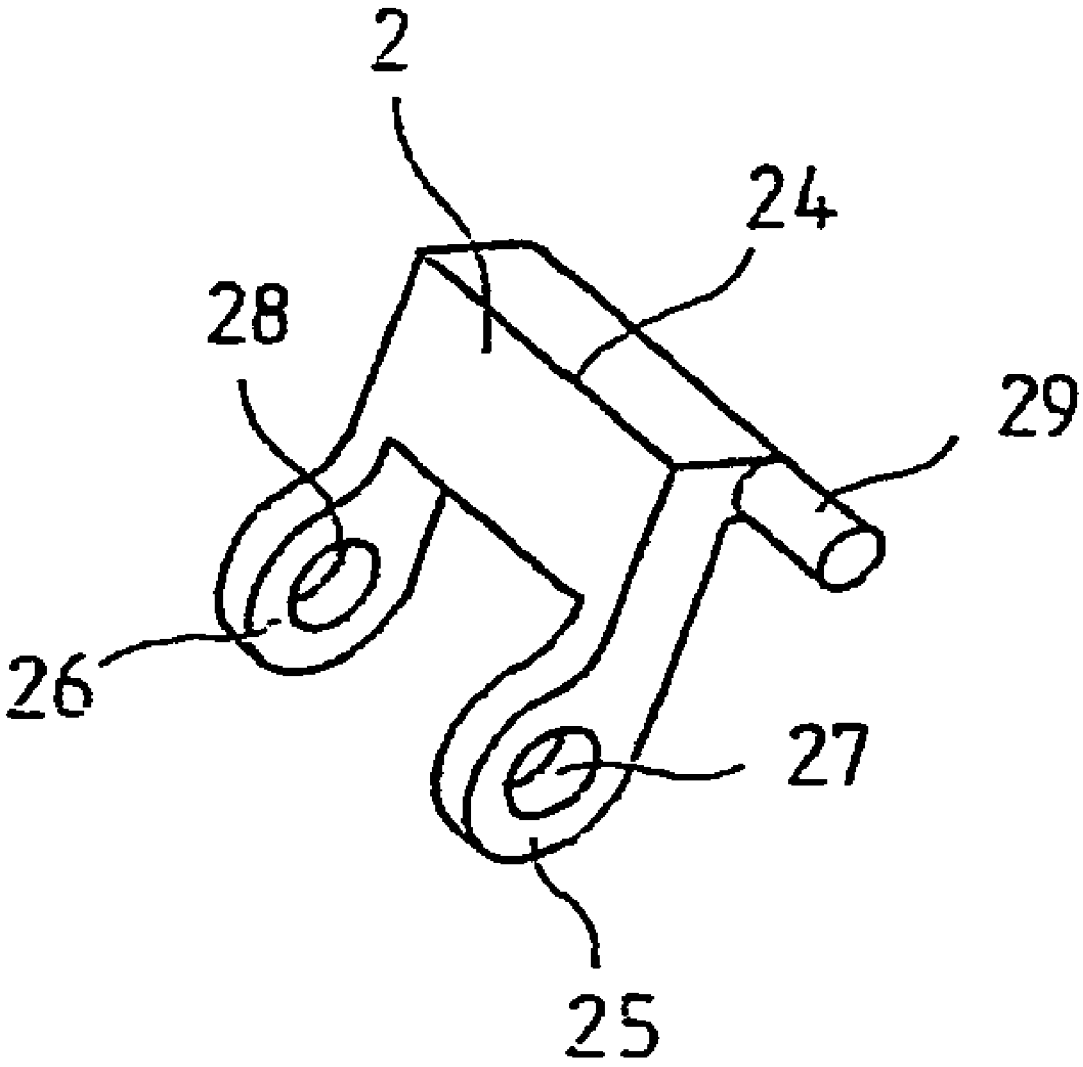
FIG. 7 shows the catch of the trigger system shown in FIGS. 1 through 4 in a schematic perspective.

In FIG. 7, the catch 2 is shown. The fork-shaped catch 2 has an upper catch edge 24 and two parallel prongs 25 and 26 that point downward, with aligned bearing holes 27 and 28 for the link pin 8. The catch 2 also contains a catch cam 29 that projects to the side, which points outward through the oblique longitudinal hole 30 shown in FIG. 1, in the side part 6 of the carrier element 7 facing the trigger bar 4 to engage with the control cam 18 of the trigger bar 4.

The operation of the trigger system according to the invention will be explained below with reference to FIGS. 1 through 4.

In FIG. 1, the trigger system is shown in an operating position under partial tension, which the trigger system reaches by manual repetition or being held back after a shot has been taken. In this operating position under partial tension, the hammer 1 is held by its engagement with the catch 2, which engages with the safety stop 17, in a position under partial tension in which the force of the hammer spring (not shown) is not yet sufficient to fire a cartridge. The back of the control cam 19 of the trigger bar 4 lies against a part of the hammer axis 5 that projects to the side. One locking edge 22 of the trigger bar 4 is situated without function in the free cut 13 of the hammer 1, while the other locking edge 21 engages with the associated fire-locking element 12 of the hammer 1.

Figure 2:
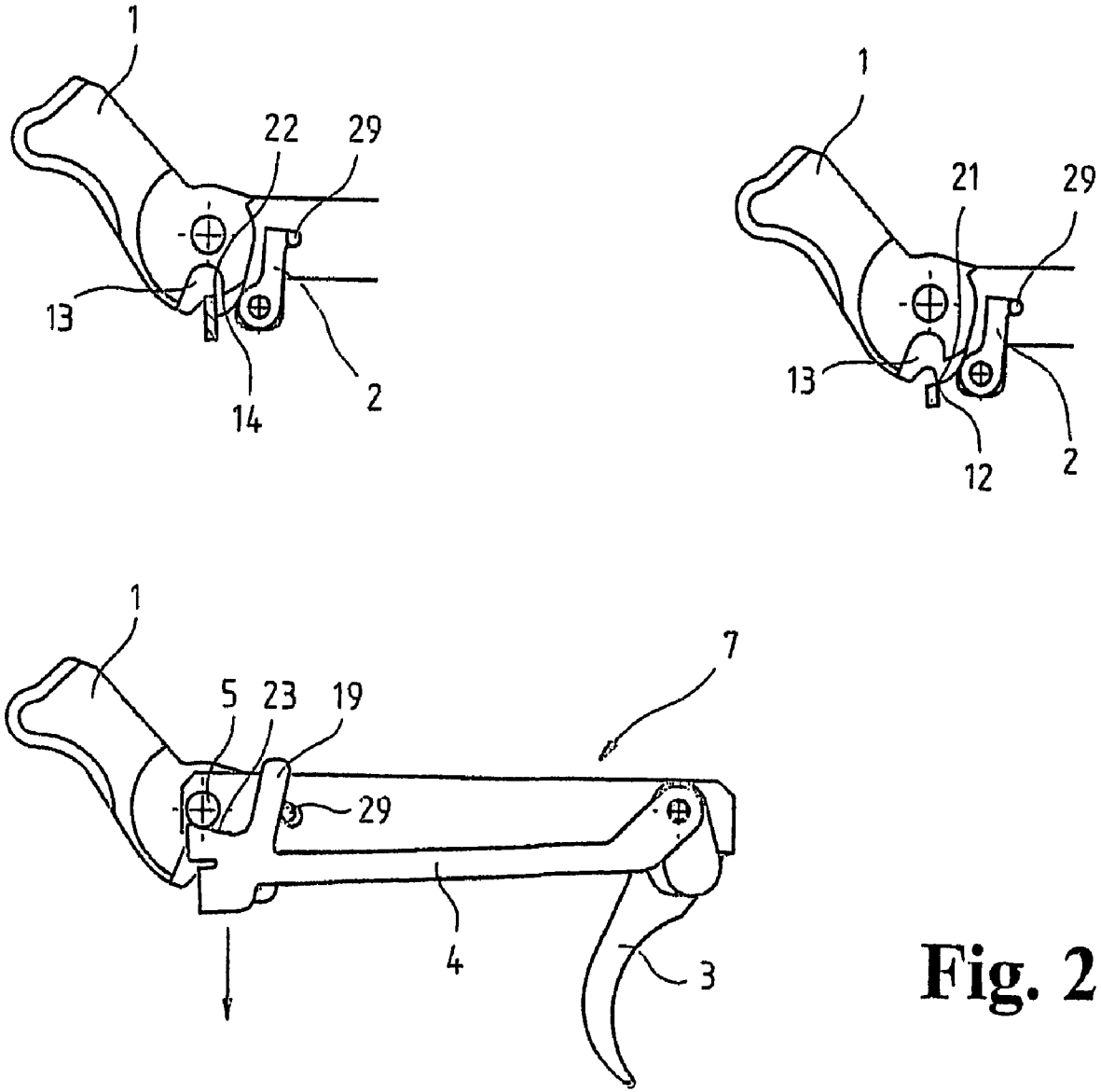
FIG. 2 shows the trigger system of FIG. 1 during activation of the trigger.

By activating the trigger 3, the hammer 1 according to FIG. 2, which is in a position under partial tension, is placed under further tension against the hammer spring (not shown) through the trigger bar 4. During the tension process, the trigger bar 4 is moved downward in the direction of the arrow by the control bevel 23 of the trigger bar 4, next to the hammer axis 5, until the locking edge 21 of the trigger bar 4 no longer engages with the associated fire-locking element 12 of the hammer 1 and the hammer is released to set off a shot. The other locking edge 22 of the trigger bar 4 is situated without function in the free cut 13 of the hammer 1. During the course of the tension process, the catch 2 is brought into a position by the control cam 19 of the trigger bar 4 and the catch cam 29 and held there, whereby the hammer 1 is enabled to strike.

Figure 3:
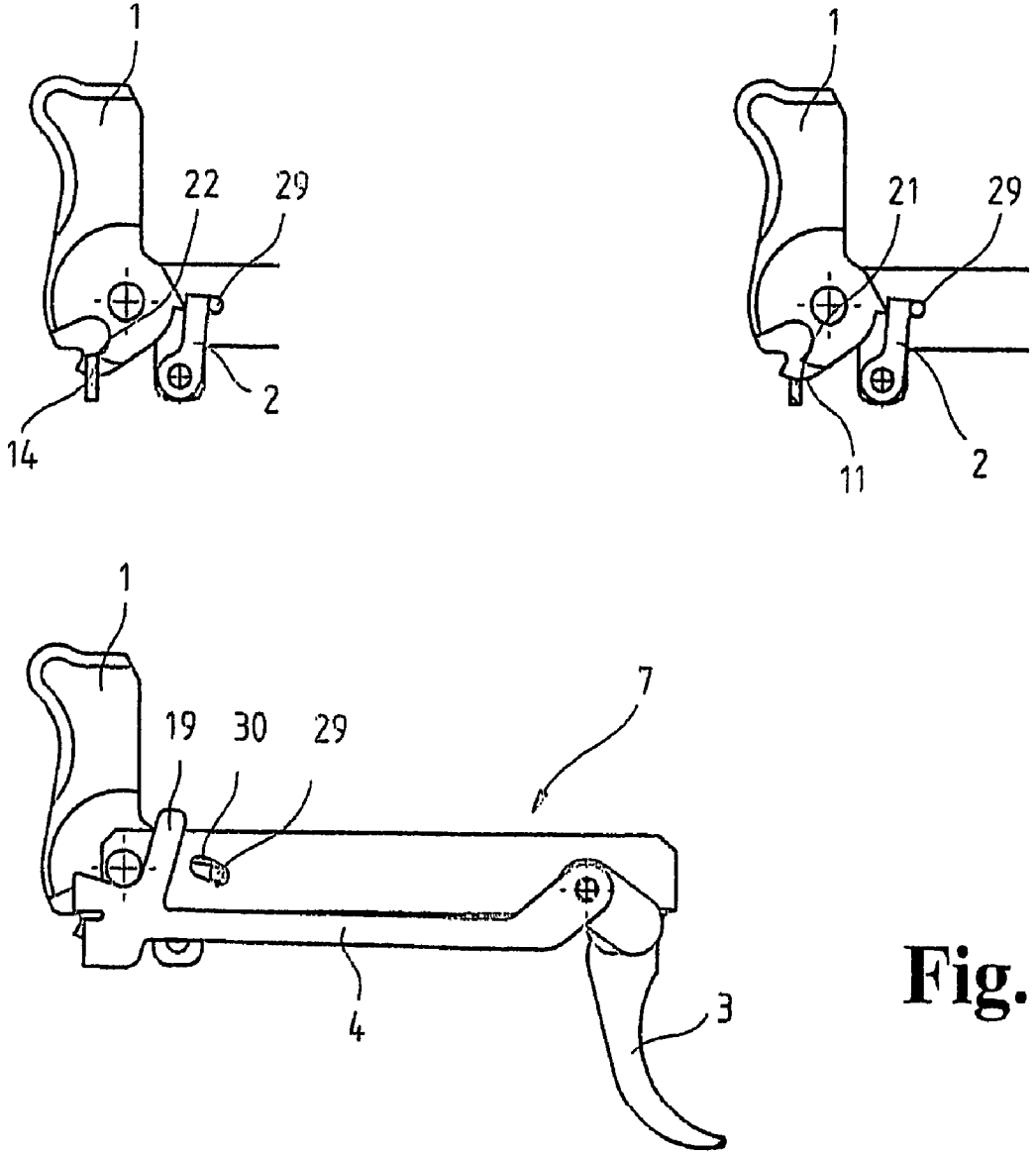
FIG. 3 shows the trigger system shown in FIG. 1 in a position after a firing failure.

In FIG. 3, the trigger system described above is shown in a position after a firing failure. The hammer 1 is in a forward exit position, completed without tension. The trigger bar 4 is located with its second locking edge 22 in the free cut 13 behind the associated fire-locking element 14, while the first locking edge 21 lies on the control arc 11 of the hammer.

Figure 4:
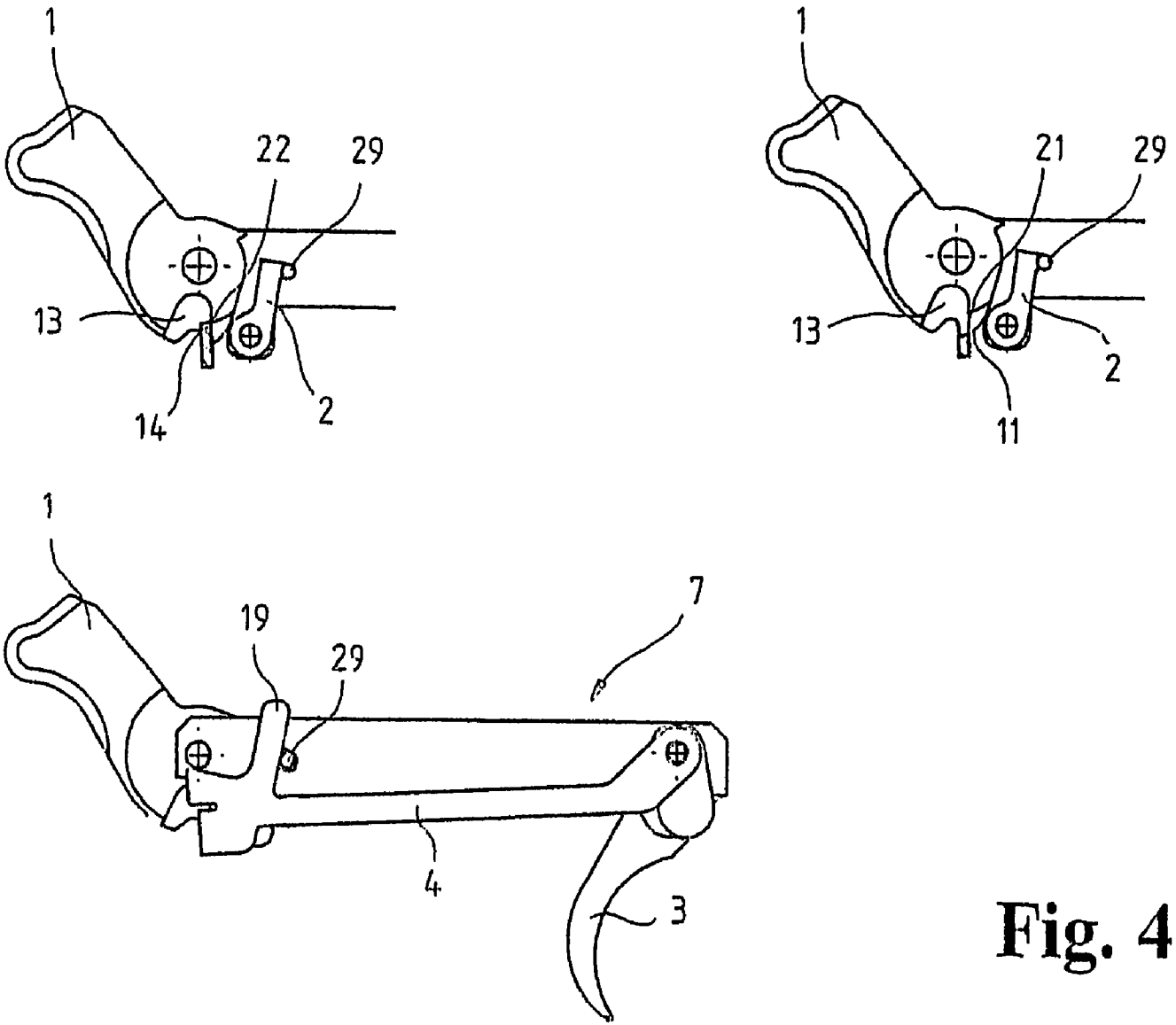
FIG. 4 shows the trigger system shown in FIG. 1 shortly before triggering of a shot after a firing failure.

When the trigger 3 is activated in this position, the hammer 1 can be placed under tension by the trigger bar 4 by the second edge 22, which engages with the second fire-locking element 14, according to FIG. 4. During this tension process, the trigger bar 4 is moved out by the control arc 11 of the hammer 1 with the adjacent first locking edge 21 of the trigger bar 4, until the second locking edge 22 of the trigger bar 4 releases the second fire-locking element 14 and the hammer can strike. At the same time, the catch 2 is brought into a position by control cam 19 of trigger bar 4 and catch cam 29 and held there, so that it is possible for the hammer 1 to strike.

The invention claimed is:

1. Trigger system for small arms comprising:

a hammer including a first fire locking element and a second fire locking element positioned on a side surface of the hammer, a catch associated with the hammer, a trigger, and a trigger bar that cooperates with the trigger, and includes a first locking edge to engage the first fire locking element of the hammer and a second locking edge to engage the second fire locking element of the hammer, wherein the second fire locking element of the hammer is a shorter distance from a through-hole through the hammer for a hammer axis than is the first fire locking element.

2. Trigger system for small arms comprising:

a hammer;

a catch associated with the hammer;

a trigger; and a trigger bar that cooperates with the trigger, and includes a first locking edge to engage with an associated first fire locking element of the hammer and a second locking edge to engage with an associated second fire locking element of the hammer, wherein the second fire locking element of the hammer is a shorter distance from a through-hole through the hammer for a hammer axis than is the first fire locking element, and wherein the first locking edge and the second locking edge are arranged on a segment of the trigger bar and laterally project in the direction of the hammer.

3. Trigger system according to claim 1, wherein the second locking edge is arranged above the first locking edge and displaced to the side with respect to it.

4. Trigger system according to claim 1, wherein the second fire locking element is arranged on a lateral free cut on the side of the hammer facing the trigger bar.

5. Trigger system according to claim 1, wherein the second fire locking element is arranged on the hammer above the first fire locking element and is displaced forward with respect to it.

6. Trigger system according to claim 1, wherein the hammer has a safety stop to engage with a catch edge of the catch.

7. Trigger system according to claim 1, wherein the trigger bar contains a control cam, through which the catch can be taken out of engagement with the safety stop of the hammer when the trigger is activated.

8. Trigger system according to claim 1, wherein the catch has a catch cam to engage with the trigger bar.

9. A trigger system for small arms comprising:

a hammer, a catch associated with the hammer, a trigger, and a trigger bar that cooperates with the trigger, and includes a first locking edge to engage with an associated first fire locking element of the hammer and a second locking edge to engage with an associated second fire locking element of the hammer, wherein the second fire locking element of the hammer is a shorter distance from a through-hole through the hammer for a hammer axis than is the first fire locking element, and a carrier element includes a first and second side part provided in a spaced apart arrangement defining a gap therebetween, wherein the trigger bar is arranged on an outside of one of the first or second side parts.

10. Trigger system according to claim 9, wherein the hammer and the catch are positioned in the gap between the first and second side pads of the carrier element.

* * * * *

UNITED STATES PATENT AND TRADEMARK OFFICE

CERTIFICATE OF CORRECTION

PATENT NO. : 7,213,358 B2
APPLICATION NO. : 11/202931
DATED : May 8, 2007
INVENTOR(S) : Harald Kellermann It is certified that error appears in the above-identified patent and that said Letters Patent is hereby corrected as shown below:

Title Page;
Column 12, under United States Patent, change the inventor's last name from "Kellerman" to --KELLERMANN--.

Column 75, under Inventor, change the inventor's last name from "Kellerman" to --KELLERMANN--.

Signed and Sealed this

Eighteenth Day of December, 2007

JON W. DUDAS
*Director of the United States Patent and Trademark Office*